US008510901B2

(12) United States Patent
Matola

(10) Patent No.: US 8,510,901 B2
(45) Date of Patent: Aug. 20, 2013

(54) MOP WRINGER

(75) Inventor: Jesse Andrew Matola, Winchester, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 4 days.

(21) Appl. No.: 13/290,289

(22) Filed: Nov. 7, 2011

(65) Prior Publication Data

US 2012/0110774 A1 May 10, 2012

Related U.S. Application Data

(60) Provisional application No. 61/411,211, filed on Nov. 8, 2010.

(51) Int. Cl.
*A47L 13/60* (2006.01)

(52) U.S. Cl.
USPC ..... 15/260; 15/262

(58) Field of Classification Search
USPC ..... 15/260, 262, 264; 68/239, 244, 68/248, 256
See application file for complete search history.

(56) References Cited

U.S. PATENT DOCUMENTS

| | | | |
|---|---|---|---|
| 4,912,804 | A | 4/1990 | Pasbol |
| 5,918,343 | A | 7/1999 | Young |
| 7,254,863 | B1 | 8/2007 | Morad |

OTHER PUBLICATIONS

International Searching Authority, International Search Report issued for International application No. PCT/US2011/059572, Mar. 5, 2012.
International Searching Authority, Written Opinion issued for International application No. PCT/US2011/059572, Mar. 5, 2012.

*Primary Examiner* — Shay Karls
(74) *Attorney, Agent, or Firm* — Dennis J. Williamson; Moore & Van Allen PLLC

(57) ABSTRACT

A drive provides rotational movement and linear movement to an output. A first gear is operatively connected to the output, such as a roller. A drive assembly comprises a first cam surface, a second cam surface and a second gear. The first cam surface engages a first follower where the first follower is operatively connected to the output such that linear movement of the first cam follower results in linear movement of the output. The second cam surface engages a stationary follower. The second gear engages the first gear. The drive assembly rotates over a range of motion such that for a first portion of the range of motion the drive assembly causes the rotational and linear movement of the output and rotation of the drive assembly for a second portion of the range of motion causes only the rotational movement of the output.

23 Claims, 11 Drawing Sheets

MOP WRINGER

This application claims benefit of priority under 35 U.S.C. §119(e) to the filing date of to U.S. Provisional Application No. 61/411,211, as filed on Nov. 8, 2010, which is incorporated herein by reference in its entirety.

BACKGROUND

It is sometimes difficult to sufficiently remove or wring water or other liquid from a mop, especially a flat mop that has a frame that supports a double sided textile mop pad. As a result, excess liquid may be left in the mop pad after wringing that prevents a user from quickly and easily picking up more liquid upon reuse of the mop.

SUMMARY

A wringer for a mop comprises a drive roller mounted for rotational movement and linear movement in a track. A first gear is operatively connected to the drive roller for rotating the drive roller. A drive assembly comprises a first cam surface, a second cam surface and a second gear. The first cam surface engages a first follower where the first follower is operatively connected to the drive roller such that linear movement of the first cam follower results in linear movement of the drive roller. The second cam surface engages a second follower where the second follower is stationary. The second gear engages the first gear. The drive assembly is mounted for rotational movement over a range of motion such that rotation of the drive assembly for a first portion of the range of motion causes the rotational movement and the linear movement of the drive roller and rotation of the drive assembly for a second portion of the range of motion causes only the rotational movement of the drive roller.

The drive roller and drive assembly may be mounted in a housing where the housing is supported on a bucket. The track may comprise spaced guide rails formed as protrusions on the housing. A driven roller may be provided where the linear movement of the drive roller is toward the driven roller. The position of the driven roller relative to the drive roller may be adjustable to vary the distance between the drive roller and the driven roller. The driven roller may be mounted on an eccentric cam wheel where rotation of the cam wheel adjusts the space between the drive roller and the driven roller. The drive roller may rotate on an axle about a first axis of rotation and the first gear may be fixed to the drive roller concentric with the axle. The first cam follower may be mounted concentric with the axle and the first gear such that the first cam follower rotates relative to the first gear.

The first cam follower may be constrained to move linearly along the track. A handle may be operatively connected to the drive assembly such that rotation of the handle results in rotation of the drive assembly about a second axis of rotation. The drive assembly may comprise a bearing that is centered on the second axis of rotation and is located in the track. The drive assembly may rotate such that the drive assembly may rotate relative to the track and translate along the track. The second gear may have the same shape as the first cam surface. The first cam surface may have a shape comprising a first portion that extends away from the second axis of rotation and a second portion that is on an arc of a circle centered on the second axis of rotation. The shape of the first cam surface may control the rate and distance of linear movement of the drive roller. The first gear may engage the second gear over the entire range of motion.

A method of operating a wringer having a driven roller and a drive roller, comprises rotating a drive assembly comprising a first cam surface, a second cam surface and a gear over a range of motion; moving a first cam follower using the first cam surface and moving the drive assembly by engaging a second follower with the second cam surface such that movement of the first cam follower and the drive assembly results in linear movement of the drive roller toward the driven roller for a first portion of the range of motion; rotating the drive roller using the gear over the entire range of motion.

A wringer for a mop comprises a drive roller mounted for rotational movement and linear movement in a track. A first gear is operatively connected to the drive roller for rotating the drive roller. A drive assembly comprises a first cam surface and a second gear where the second gear has a non-round shape for at least a portion of the second gear. The first cam surface engages a stationary follower and the second gear engages the first gear. The drive assembly is mounted for rotational movement over a range of motion such that rotation of the drive assembly for a first portion of the range of motion causes the rotational movement and the linear movement of the drive roller and rotation of the drive assembly for a second portion of the range of motion causes only the rotational movement of the drive roller.

A drive provides rotational movement and linear movement. A first gear is operatively connected to an output. A drive assembly comprises a first cam surface, a second cam surface and a second gear. The first cam surface engages a first follower where the first follower is operatively connected to the output such that linear movement of the first cam follower results in linear movement of the output. The second cam surface engages a second follower where the second follower is stationary. The second gear engages the first gear. The drive assembly rotates over a range of motion such that rotation of the drive assembly for a first portion of the range of motion causes the rotational movement and the linear movement of the output and rotation of the drive assembly for a second portion of the range of motion causes only the rotational movement of the output.

DETAILED DESCRIPTION OF PREFERRED EMBODIMENTS OF THE INVENTION

Figure 1:
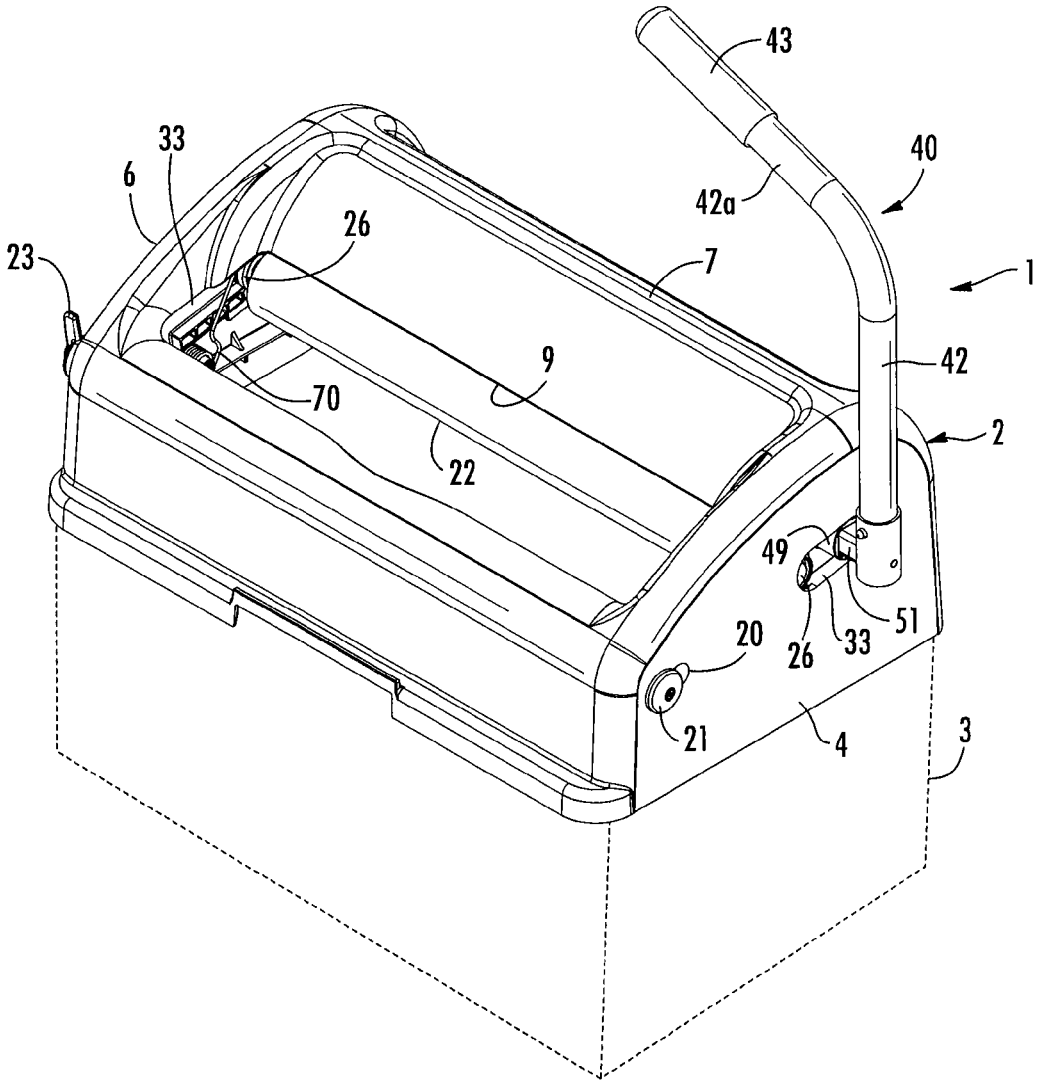
FIG. 1 is a perspective view of an embodiment of the wringer of the invention.

One embodiment of the wringer 1 is shown in FIGS. 1-4 and comprises a housing 2 that supports the wringer components. The housing is dimensioned such that it may be supported on the top edge of a bucket 3 or other similar receptacle such that liquid wrung from a mop may be collected in the bucket. The bucket may have a variety of configurations. The wringer 1 may be formed integrally with the bucket such that the wringer is permanently affixed to the bucket. For example, the housing 2 may be molded integrally with a bucket. Alternatively, the wringer 1 may be formed separately from the bucket and may be releasably mounted on the top edge of the bucket.

The housing 2 comprises a first housing side panel 4 and an opposed second housing side panel 6 joined by a housing shroud 7 to form the housing 2. The shroud 7 defines an opening 9 such that a mop may be inserted into the opening 9 and passed through the housing 2 and wringer 1 into a bucket located below the wringer 1. Housing 2 may be molded of plastic as one piece or the housing may be constructed of individual components joined together to create an integral unitary housing. Further, while the housing is shown as having a substantially rectilinear shape it may have any suitable configuration.

A free spinning driven roller 10 is mounted between the side panels 4 and 6 such that the roller 10 may rotate about its longitudinal axis. The driven roller 10 may comprise a rigid cylindrical roller body on which a cover 14 is mounted. The cover 14 may comprise a relatively soft material such as an elastomer. The driven roller 10 is supported for rotational movement about axle 16 that extends from each end of the roller 10. The ends of axle 16 are fixed in cylindrical sleeves 18 in eccentric cam wheels 19. The sleeves 18 extend from the outer side of the cam wheels 19 and are received in slots 20 formed in side panels 4 and 6. Springs 25 bias the cam wheels 19 against pins 27 formed on side panels 4 and 6. A cap 21 is fixed to axle 16 to retain one of the cam wheels in slot 20 in side panel 4 and a knob 23 is fixed to the other end of axle 16 to retain the other cam wheel in slot 20 in side panel 6. Knob 23 may be manipulated by the user to allow the user to adjust the position of driven roller 10 relative to drive roller 22 to vary the spacing between the rollers.

The cam wheels 19 are mirror images of one another and the arrangement of the cam wheel 19 is the same on both ends of the roller 10 such that specific explanation of the operation of the cam wheel will be made to one cam wheel. The slot 20 is formed in panel 6 such that the driven roller 10 is able to move toward and away from the drive roller 22 to change the distance between the rollers. To adjust the position of the roller 10 the cam wheels 19 rotated about sleeve 18 by the user by rotating the knob 23. As the cam wheel 19 rotates the peripheral surface of the cam wheel contacts pin 27 formed on the side wall 6. Because the periphery of cam wheel 19 is eccentric relative to sleeve 18 and axle 16, rotating the cam wheel 19 changes the position of axle 16 in slot 20 toward and away from the drive roller 22 such that the distance between the rollers may be adjusted. The cam wheel 19 may be provided with a plurality of depressions 17 about the periphery of the cam wheel that engage the pin 27 such that the cam wheel 19 may be located in discrete rotational orientations.

Drive roller 22 is also mounted between the side panels 4 and 6 such that the roller 22 may rotate about its longitudinal axis A-A and move linearly toward and away from the driven roller 10 to squeeze a mop positioned between the rollers 10 and 22 and to move the mop upwardly to wring liquid from the mop, as will hereinafter be explained. The drive roller 22 comprises a rigid cylindrical roller body on which a cover 24 is mounted. The cover 24 may comprise a relatively soft material such as an elastomer. Each end of the drive roller 22 is supported for rotational movement on an axle 29 that is formed integrally with a spur gear 32, provided with gear teeth 32*a*, is fixed to each end of the roller body 22 concentric with axle 29 such that rotation of the gear 32 results in rotation of the drive roller 20 on axles 29 about the longitudinal axis A-A.

A cylindrical front cam follower 26 is mounted at each end of roller 22 concentric with axles 29 and gears 32. The cam followers 26 are mounted on the axles 29 such that cam followers 26 can rotate relative to the gears 32 and axles 29. The cam followers 26 are located between and constrained to move linearly along a tracks 33 formed on side panels 4 and 6. The track 33 may comprise spaced guide rails 28 and 30 where the guide rails 28 and 30 may be formed as protrusions on the inside surfaces of the side panels 4 and 6. The track 33 is configured such that the cam followers 26 may ride on the track 33 in a linear path. The tracks 33 and slots 20 are aligned such that the drive roller 22 and driven roller 10 move toward and away from one another on the same plane. The cam followers 26 function primarily to maintain the pitch diameters between gear 32 and gear 66 and may be eliminated if the force is transmitted via the engagement of gears 32 and 66. If cam followers 26 are not used, cam surfaces 52 may be eliminated. Further, the pitch diameters may be maintained by a mechanism other than followers 26.

A handle assembly 40 is also mounted on the housing to move the drive roller 22 into functional engagement with a mop positioned between the drive roller 22 and the driven roller 10. The handle assembly 40 comprises a handle 42 that extends generally upwardly from the wringer in the non-actuated position and that can be rotated by a user to actuate the wringer. The handle 42 terminates in a substantially horizontal portion 42*a* at its upper end. The horizontal portion 42*a* may be provided with a grip 43 that may be grasped by the user to rotate the handle 42 as will be described. The lower end of the handle 42 is connected to drive assemblies 50 such that rotation of the handle 42 results in rotation of the drive assemblies 50 about an axis of rotation B-B. The lower end of handle 40 may be connected to a non-round rod 51 that engages mating non-round receptacles 53 on the drive assemblies 50.

Each drive assembly 50 comprises a cylindrical bearing 49 that is centered on the axis of rotation of the drive assembly 50 and that is located in track 33 such that the bearing 49 may rotate relative to the guide rails 28 and 30 and translate along the linear path defined by guide rails 28 and 30. When the handle 42 is rotated from the vertical rest position (FIGS. 5*a* and 6*a*) to the past-horizontal actuated position (FIGS. 5*d* and 6*d*) the bearings 49 rotate between and translate along the guide rails 28 and 30 such that the drive assemblies 50, rod 51 and handle assembly 40 all may rotate and translate relative to the housing 2 as will be described. A slot 55 is provided in side panel 4 to accommodate the translation of rod 51 relative to housing 2.

Figure 2:
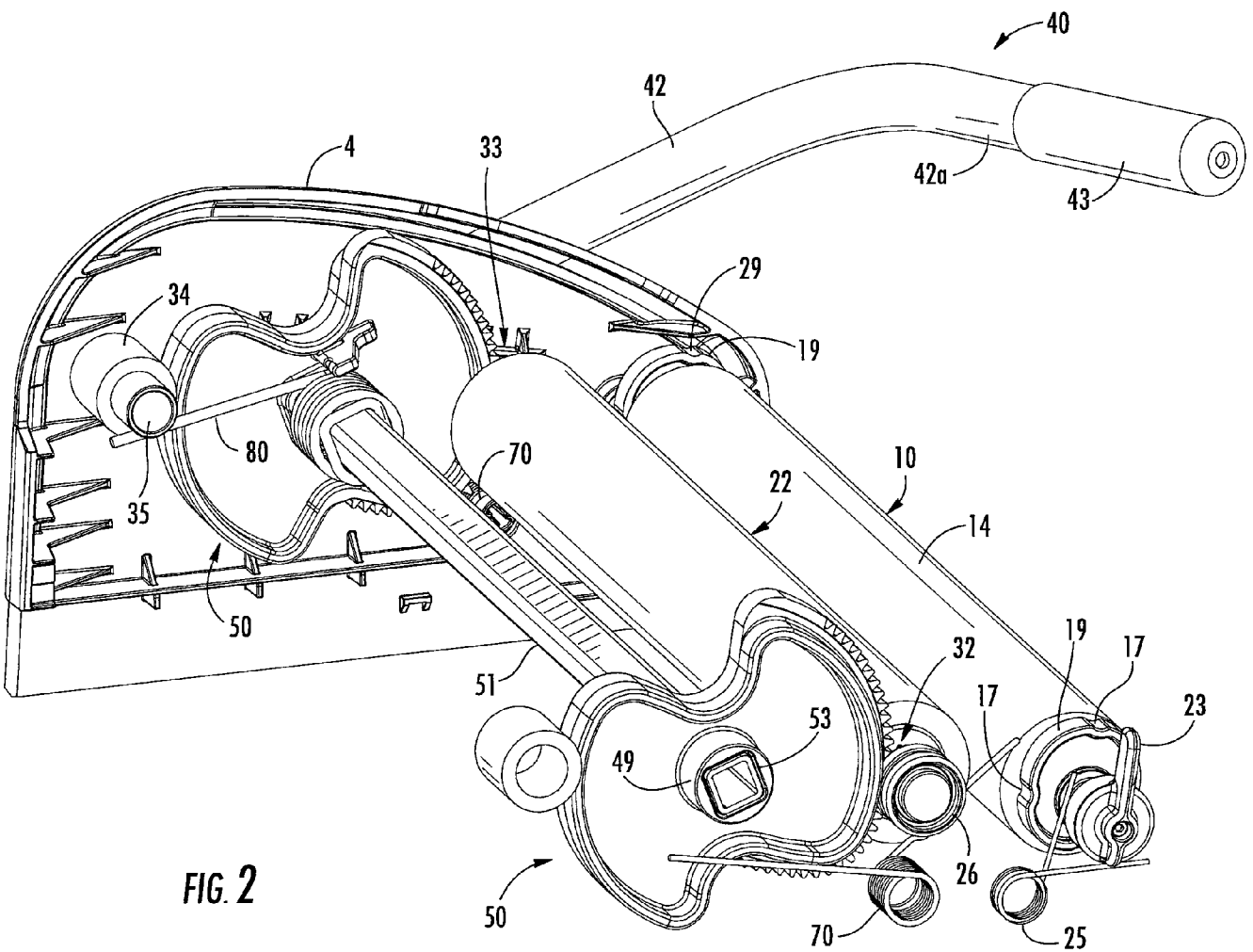
FIG. 2 is a perspective view of the embodiment of the wringer of FIG. 1 with one side panel and shroud removed.
Figure 3:
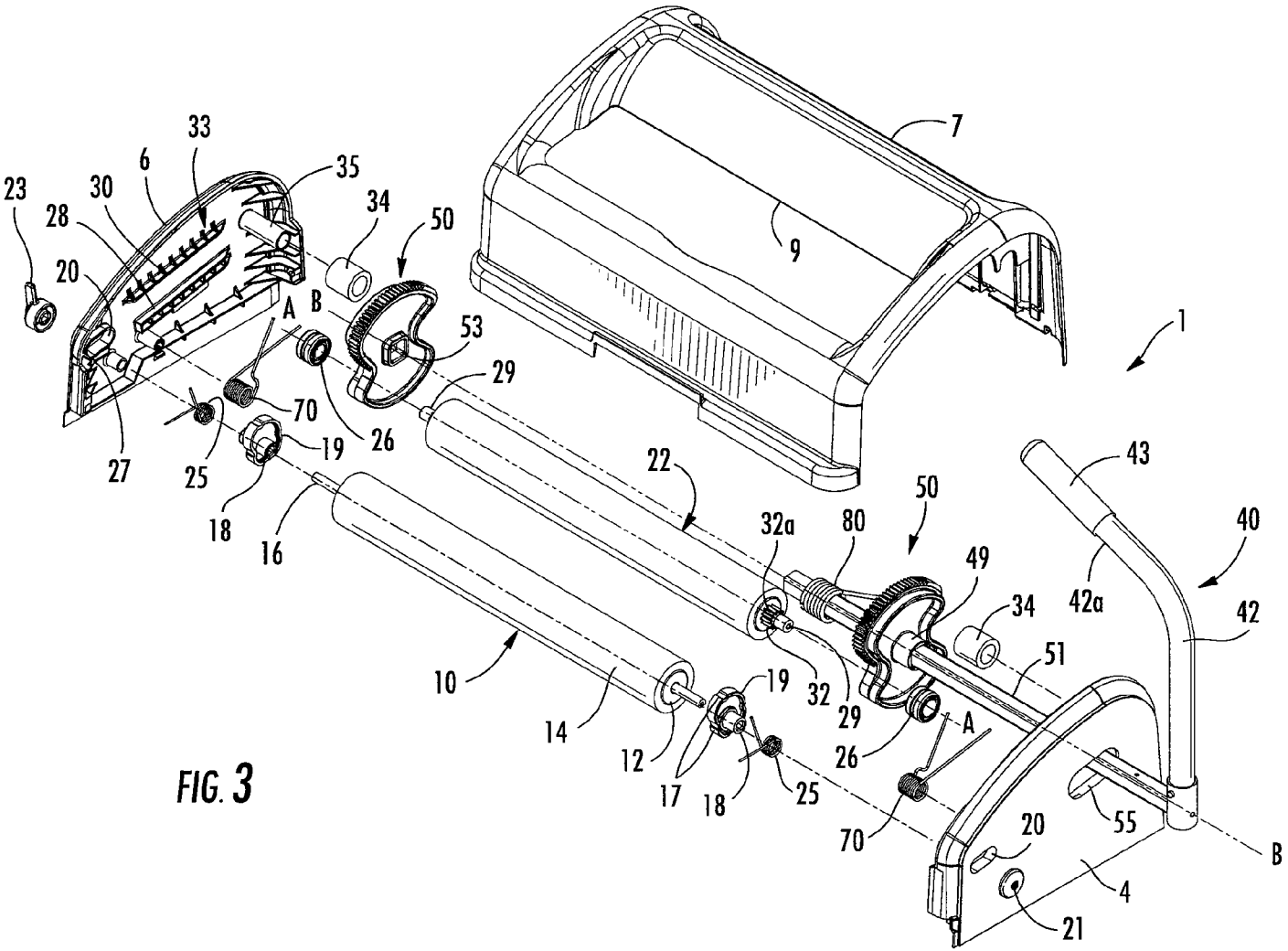
FIG. 3 is an exploded perspective view of the embodiment of the wringer of FIG. 1.
Figure 4:
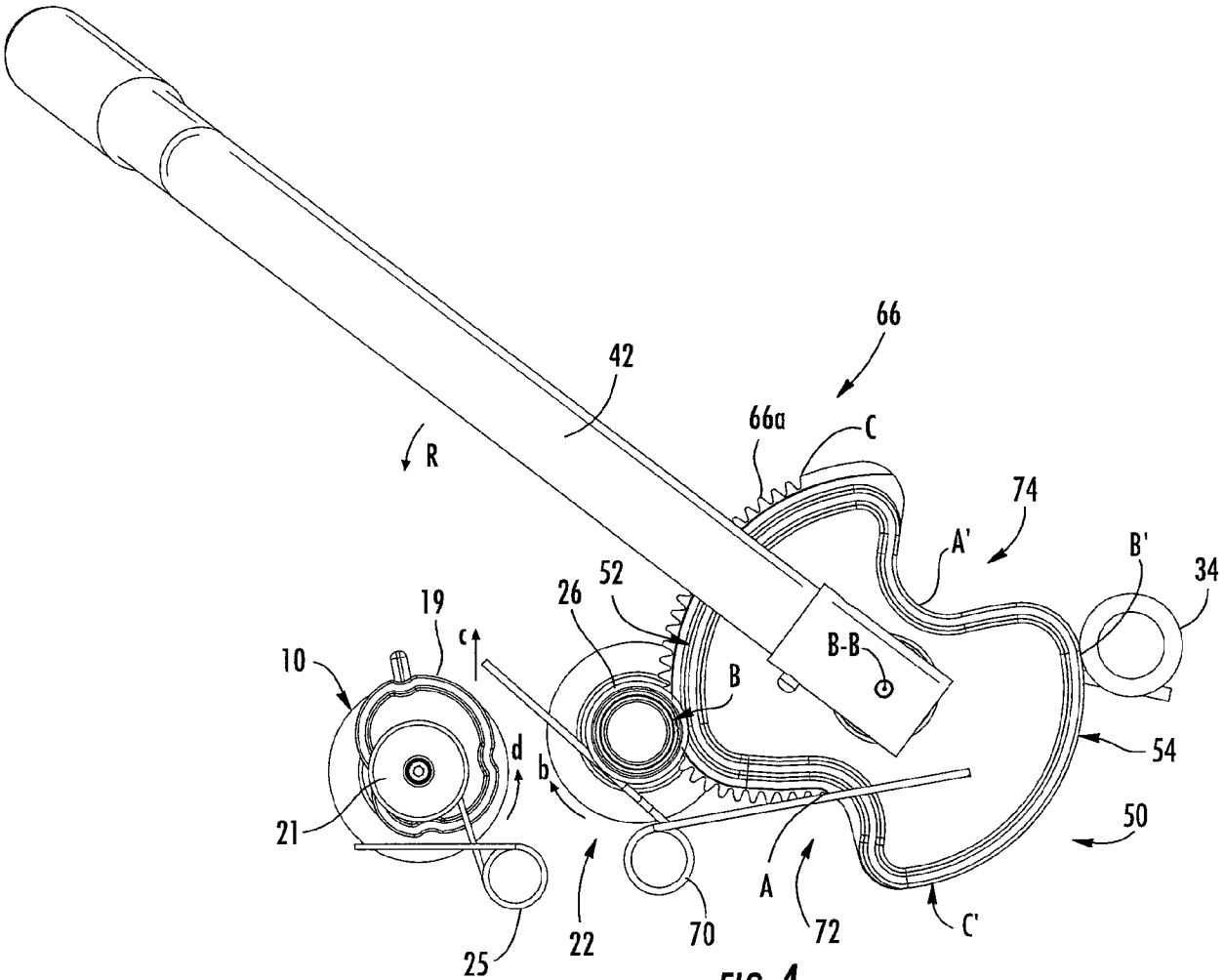
FIG. 4 is a detailed side view of an embodiment of one drive assembly.
Figure 6A:
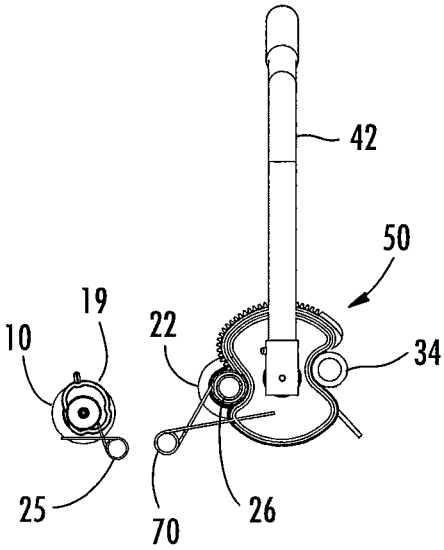
FIGS. 6*a*-6*d* show the movement of the drive assembly and rollers corresponding to FIGS. 5*a*-5*d*.

The left side and right side drive assemblies 50 are identical such that specific description will be made to one drive assembly 50. Referring to FIGS. 2, 4 and 6*a*, drive assembly 50 comprises a first, front cam surface 52 and a second, rear cam surface 54. A contoured gear 66 having teeth 66*a* is provided adjacent to the first cam surface 52 and has the same shape as the first cam surface 52. The gear 66 is positioned on drive assembly 50 such that the gear teeth 66*a* engage the teeth 32*a* of spur gear 32 when front cam surface 52 engages front follower 26. One leg of a torsion spring 70 is seated against the front follower 26 and the other leg of the torsion spring 70 is seated against the side panels 4 and 6 such that the spring 70 exerts a force on the front follower 26 that tends to bias the front follower 26 against the first cam surface 52, the spur gear 32 against the gear 66, and the rear cam surface 54 against the rear cam follower 34. The rear cam followers 34 are mounted on the pins 35 on side panels 4 and 6 such that the followers 34 are free to rotate relative to the pins 35. The pins 35 are mounted in a fixed position on the side panels 4 and 6 such that the rear followers 34 re in a fixed position in housing 2.

Figure 6B:
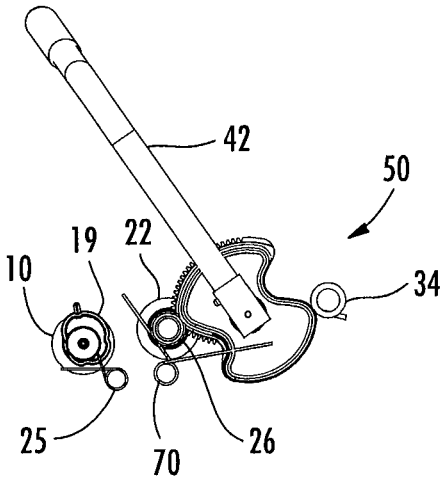
Figure 6C:
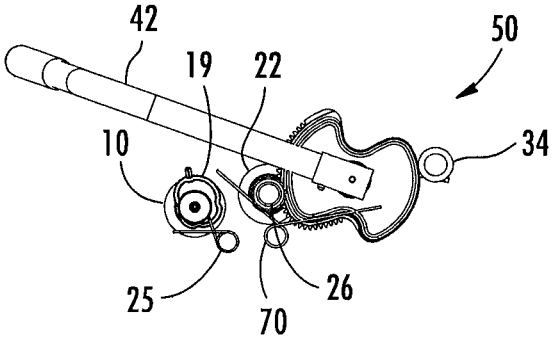
Figure 6D:
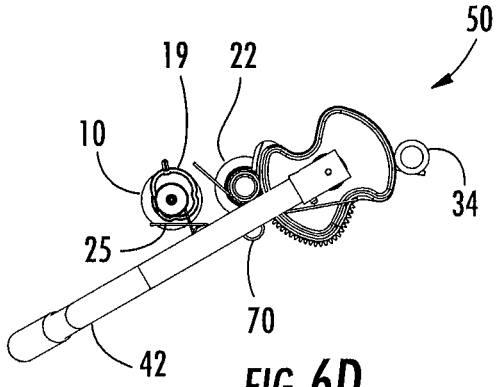

The drive assembly 50 is configured such that the drive roller 22 is initially rotated and moved in a linear path toward the driven roller 10 (FIG. 6*a* to FIG. 6*b*). Once the drive roller 22 reaches a predetermined distance from the axis B-B, linear movement of the drive roller 22 is stopped (FIG. 6*b*) and the drive roller 22 is only rotated about its longitudinal axis A-A by the continued rotation of handle 40 (FIG. 6*b* to FIG. 6*d*).

The cam surfaces 52 and 54 are shaped such that recessed areas 72 and 74 are formed at the first end of the first cam surface 52 and the second cam surface 54, respectively. Recessed areas 72 and 74 receive the front follower 26 and the stationary rear follower 34 when the handle 40 is in the non-actuated, substantially vertical position as shown in FIG. 6*a*. In the recessed areas 72 and 74 the cam surfaces are relatively nearer to the axis of rotation B-B of the drive assemblies 50. The recessed areas 72 and 74 create a narrowed area of the drive assembly 50 that allows the front cam follower 26 to move relatively closer to the rear cam follower 34 to thereby allow the drive roller 22 to move away from the driven roller 10 a relatively larger distance when the handle is in the non-actuated position. In this position the drive roller 22 is spaced from the driven roller 10 a maximum distance to allow a mop to be inserted between the rollers. The gear teeth 66*a* of gear 66 follow recess 72 such that even in the non-actuated position the gear teeth 66*a* are engaged with the gear teeth 32*a* of spur gear 32.

The cam surfaces 52 and 54 extend closest to the axis of rotation B-B at Points A and A', which identify the trough of the recessed areas 72 and 74. The cam surfaces 52 and 54 gradually extend away from the axis of rotation B-B between Points A and B and Points A' and B', respectively. As a result, as the followers 26 and 34 traverse the cam surfaces 52 and 54 between Points A, B and A', B', respectively, the followers 26 and 34 move away from the axis of rotation B-B until at Points B, B' the followers 26 and 34 are at a maximum distance from the axis of rotation B-B (FIGS. 4 and 6*b*). In this position the drive assembly 50 is moved furthest away from cam follower 34 along track 33 toward driven roller 10 by the engagement of cam surface 54 with stationary follower 34. The driven roller 22 is moved furthest along track 33 toward roller 10 by the engagement of cam surface 52 with follower 26. At the same time, the gear teeth 66*a* on drive gear 66 act on the drive roller spur gear 32 causing the drive roller gear 32 and drive roller 22 to rotate in the direction of arrow b. The drive roller 22 is moved closest to the driven roller 10 in this position such that the rollers 10 and 22 may exert a maximum wringing force on a mop disposed between the rollers. The shape of the cam surfaces 52 and 54 between Points A, A' and B, B', respectively, controls the rate at which the rollers approach one another and the final distance between the rollers.

Figure 7A:
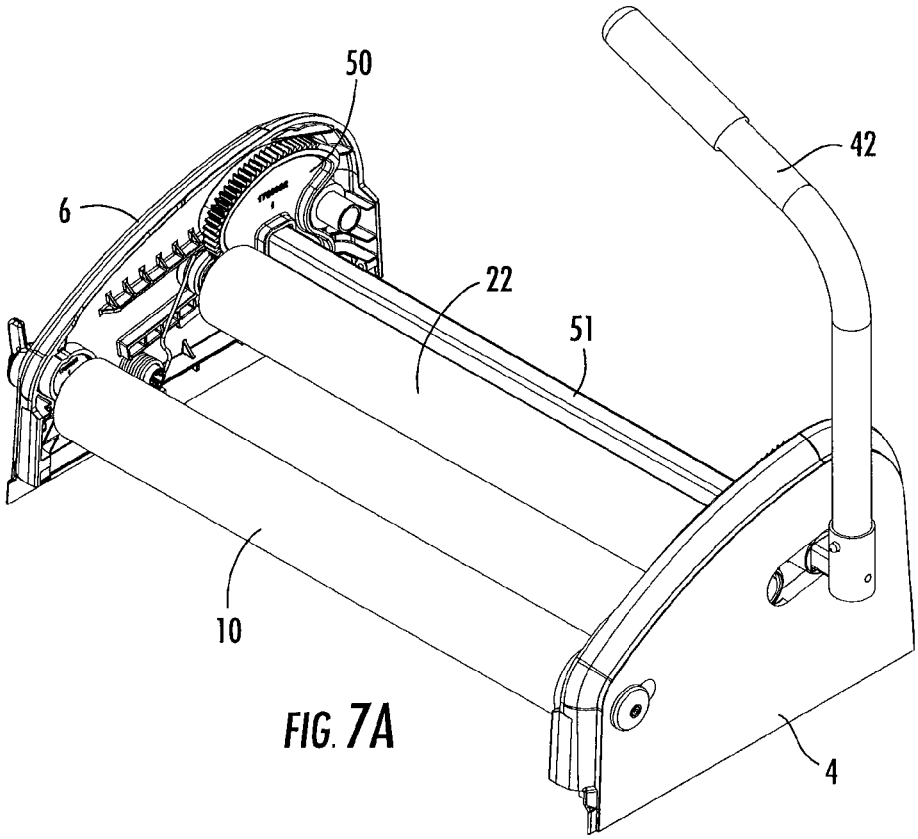
FIGS. 7*a*-7*d* show a perspective view of the movement of the drive assembly and rollers corresponding to FIGS. 6*a*-6*d*.

Points C and C' identify the functional end of the cam surfaces 52 and 54, respectively. Between Point B and Point C and between Point B' and Point C' the cam surfaces 52 and 54 define substantially arcs of a circle centered about the axis of rotation B-B. As a result, a constant spacing between the followers 26 and 34 is maintained as the followers 26 and 34 traverse the cam surfaces 52 and 54 between Point B and Point C and Point B' and Point C', respectively. The drive roller 22 is not moved linearly toward the driven roller 10 during this portion of rotation of the handle 42 and drive assemblies 50 (FIGS. 7*c*-7*d*). While the drive roller 22 is not moved linearly, the gear teeth 66*a* on drive gear 66 act on the drive roller spur gear 32 causing the drive roller spur gear 32 and roller 22 to rotate in the direction of arrow b over this range of motion.

The drive assemblies 50 move through a range of motion between the non-actuated position of FIG. 6*a* to the fully actuated of position 6*d*. At the beginning of the range of motion the followers 26 and 34 are located at the Points A, A' respectively, and at the end of the range of motion the followers 26 and 34 are located at the Points C, C' respectively. For a first portion of the range of motion of the drive assemblies 50 the drive roller 22 is both rotated and moved linearly toward the driven roller 10 and for a second portion of the range of motion of the drive assembly the drive roller 22 is rotated but is not moved linearly toward the driven roller 10. The first portion of the range of motion is the motion between FIGS. 6*a* and 6*b* where the follower 26 traverses the cam surface 52 between Point A and Point B and follower 34 traverses the cam surface 54 between Point A' and Point B'. The second portion of the range of motion is the motion between FIGS. 6*b* and 6*d* where the follower 26 traverses the cam surface 52 between Point B and Point C and follower 34 traverses the cam surface 54 between Point B' and Point C'.

When the handle 42 is rotated in the direction of arrow R, the drive assemblies 50 are also rotated causing the cam surfaces 52 and 54 to exert a force on the front cam follower 26 and the rear cam follower 34, respectively, as previously described. Because the rear follower 34 is mounted in a fixed position on the housing 2 the engagement of the cam surface 54 with the rear follower 34 causes the drive assembly 50, the front follower 26 and drive roller 22 to move linearly away from the rear follower 34 and toward driven roller 10 along the path defined by the guide rails 28 and 30. Simultaneously the front cam surface 52 moves the front follower 26 and drive roller 22 away from the axis of rotation B-B of the drive assembly 50 and toward driven roller 10 along the path defined by the guide rails 28 and 30. The gear teeth 66*a* on drive gear 66 act on the drive roller spur gear 32 causing the drive roller gear 32 and roller 22 to rotate in the direction of arrow b during the entire range of motion.

This combined action moves the drive roller 22 towards the driven roller 10 as the drive roller 22 is simultaneously rotated about its longitudinal axis A-A. The spacing between the drive roller 22 and the driven roller 10 is selected such that a flat mop located between the rollers will be squeezed by the wringer action of the rollers. Because drive roller 22 is positively rotated by handle 40 via the engagement of drive gear 66 and gear 32, the drive roller 22 imparts motion to the mop causing the mop to be pulled upwardly (in the direction of arrow c) between the rollers 10 and 22 as the as the rollers 10 and 22 squeeze the mop. The rotational motion of the drive roller 22 is imparted to the driven roller 10 (in the direction of arrow d) by the upward vertical movement of the mop squeezed between the rollers.

Figure 5A:
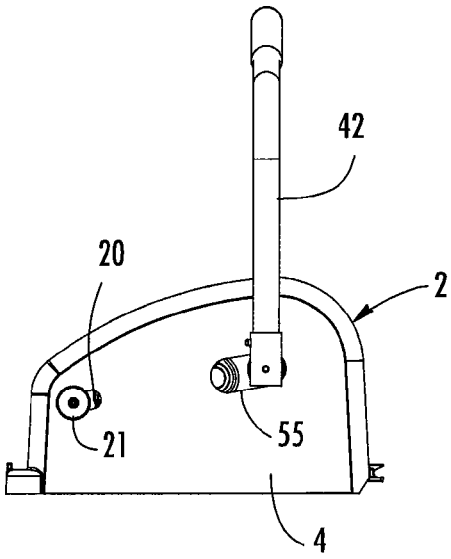
FIGS. 5*a*-5*d* show a side view of the movement of the wringer during use.

Operation of the device will be described with reference to FIGS. 5*a*-5*d*, 6*a*-6*d* and 7*a*-7*d*. FIGS. 5*a*, 6*a* and 7*a* show the wringer in the rest position before the handle 42 is rotated. In this position the handle 42 is disposed substantially vertically with front follower 26 in recess 72 and rear follower 34 in recess 74. The rollers 10 and 22 are spaced from one another a maximum distance for receiving a mop therebetween.

Figure 5B:
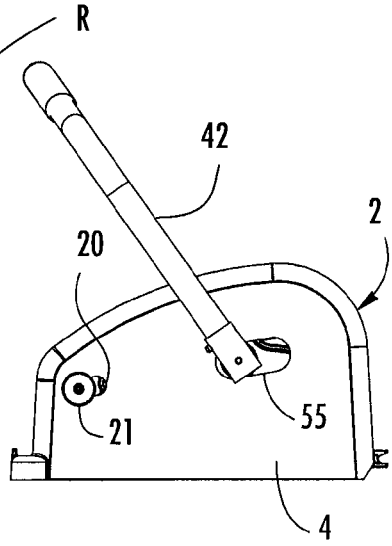
Figure 7B:
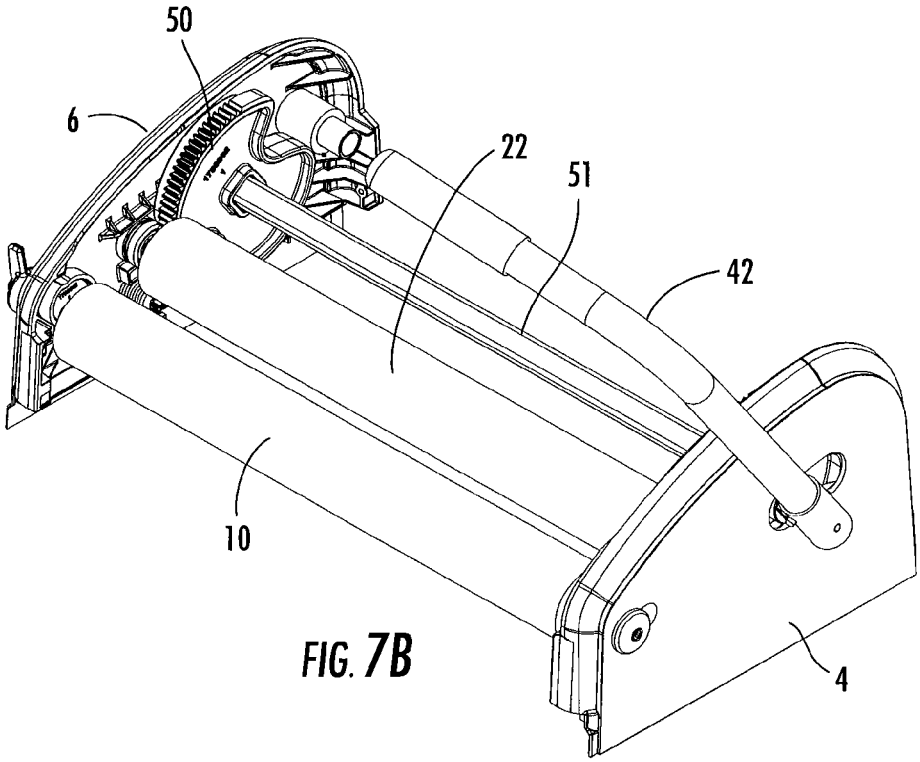
Figure 7C:
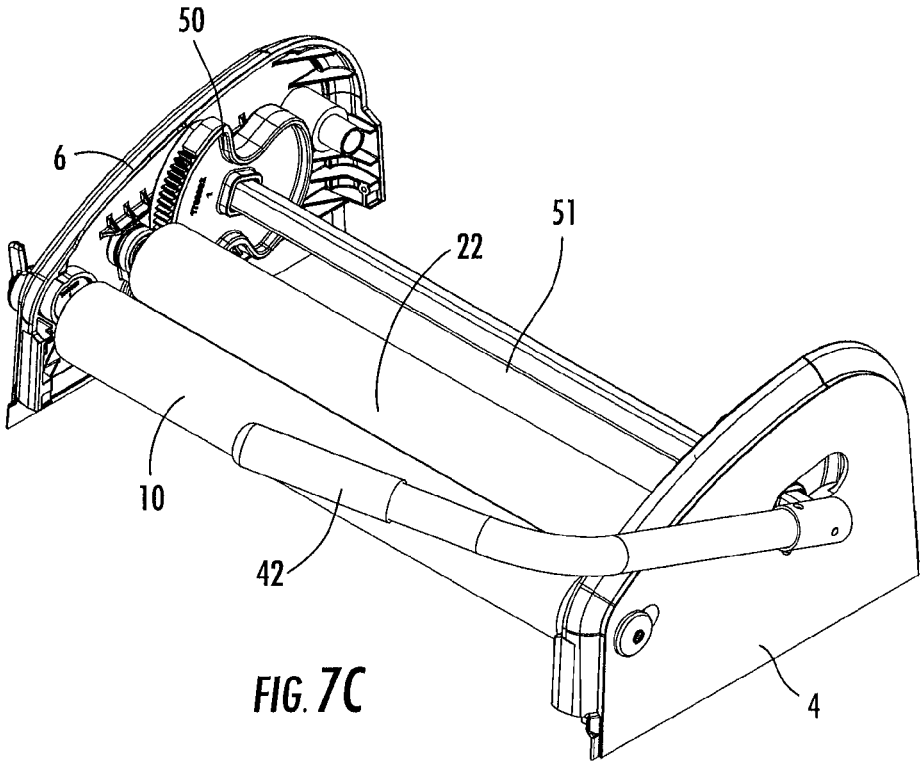
Figure 7D:
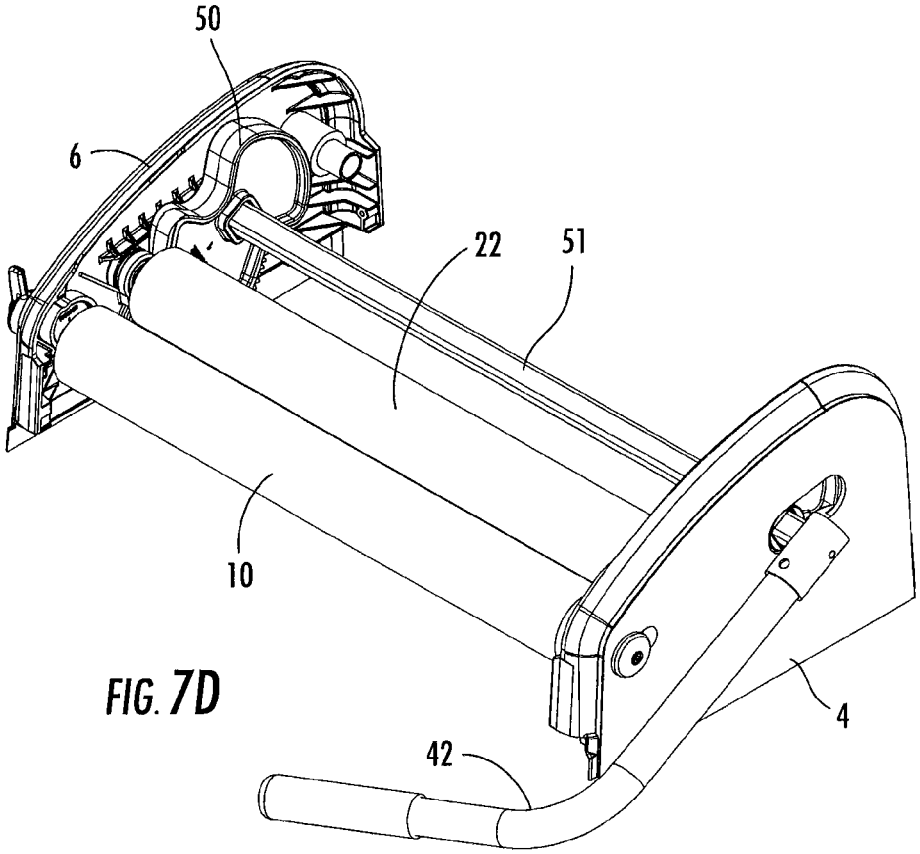

As the handle 42 is rotated by the user to rotate the drive assemblies 50, the wringer moves from the position of FIGS. 5*a*, 6*a* and 7*a* to the position of FIGS. 5*b*, 6*b* and 7*b*. As the drive assemblies 50 rotate, the cam surface 54 rides on stationary rear followers 34. Cam surfaces 54 are shaped such that the drive assemblies 50, drive roller 22 and handle assembly 40 are moved toward the driven roller 10 as previously described. Cam surface 52 is shaped such that the drive roller 22 is also moved away from the drive assemblies 50 and toward the driven roller 10 as previously described.

Figure 5C:
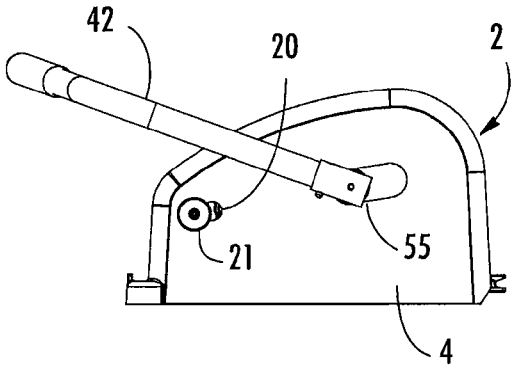
Figure 5D:
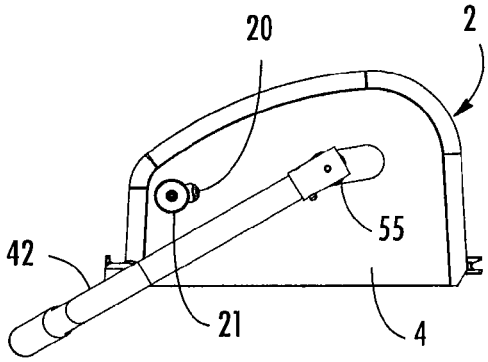

FIGS. 5*b*, 6*b* and 7*b* show the wringer at the approximate point where linear movement of the drive roller 22 toward driven roller 10 begins to stop and the drive roller 22 is only rotated by further movement of the handle 42. FIGS. 5*c*, 6*c* and 7*c* show the portion of the range of motion where the engagement of gears 32 with gears 66 rotate the roller 22 but, because cam surfaces 52 and 54 are arcs of a circle centered on axis B-B, the roller 22 does not move linearly toward roller 10. As shown in FIGS. 6*c* and 6*d* the rollers do not approach one another during this portion of the range of motion. FIGS. 5*d*, 6*d* and 7*d* show the wringer at the approximate end of the range of motion. At this point the mop would be completely withdrawn from between the rollers. The handle 42 may be released. Upon release of the handle and the handle and drive assemblies are returned to the position of FIG. 7*a* by spring 80, that has one end secured to rod 51 and the opposite end biased against pin 35, and spring 70. Spring 80 moves the assemblies from Point C to just beyond Point B and spring 70 completes rotation of the assemblies back to Point A.

The shape of the cam surfaces 52 and 54 and gear 66 may be varied to change the relative closing speed and pattern of the output (roller 22) relative to the input (handle 42). The gear ratios between gears 66 and spur gears 32 may vary to change the relative speed of rotation between the input (handle 42) and the output (roller 22). The system provides for the application of relatively high forces at the output upon the application of a relatively low force applied to the input.

Figure 8:
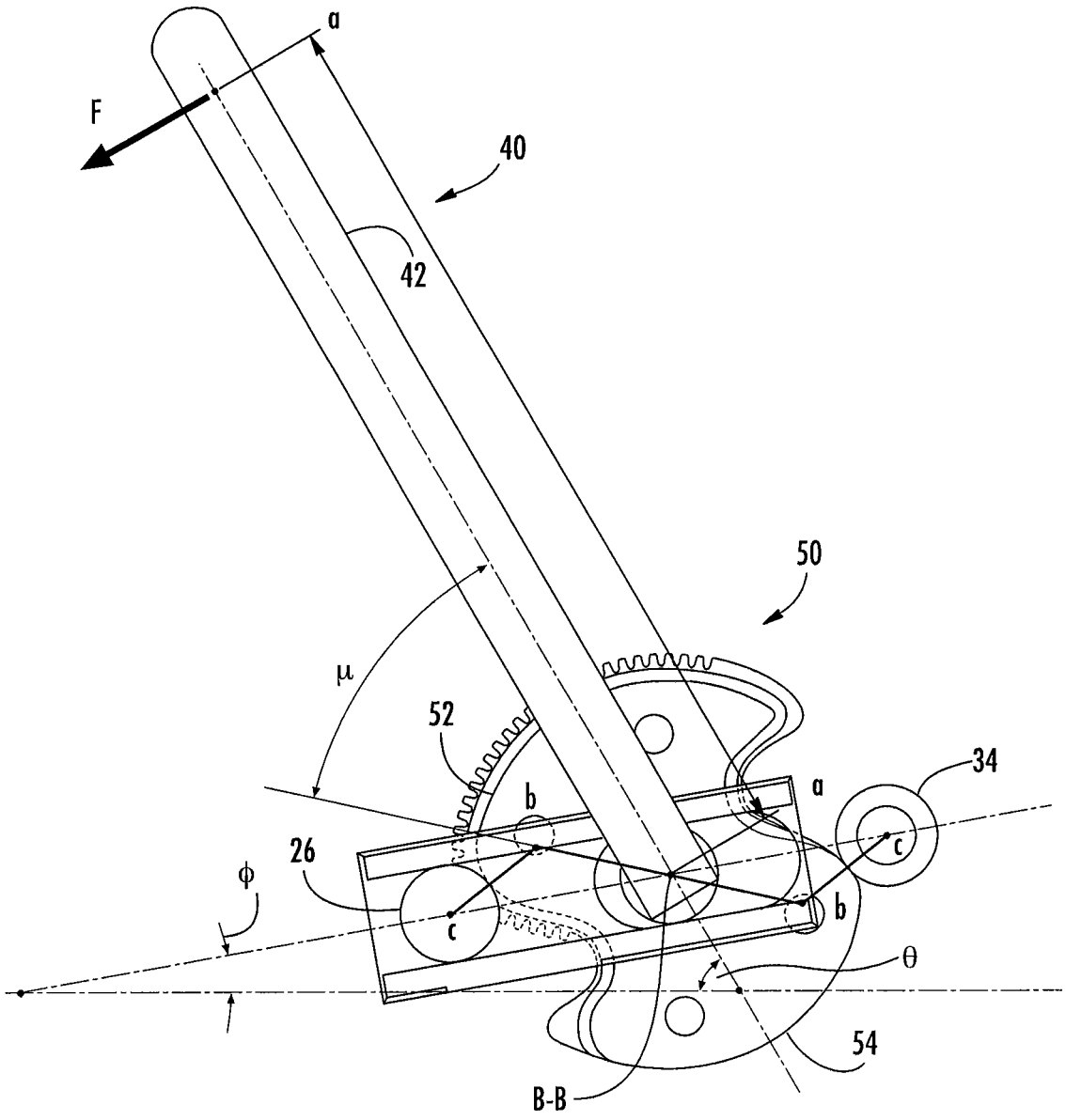
FIG. 8 is a side view of the drive assembly illustrating the operation of the drive assemblies.

FIG. 8 shows a model of the drive linkage overlayed on drive assembly 50 and handle assembly 40. Line a-a is the length of the handle 42 from the point of application of the force F to the axis of rotation B-B of the drive assembly 50. In the illustrated example a 60 lb force is applied normal to line a-a and line a-a is assumed to have a length of the 11.5 inches. Line b-b is the lever arm of the drive assembly 50 through the axis of rotation B-B to the point of contact with the front follower 26 and rear follower 34 where the force is applied in a direction normal to the surface of the followers along lines b-c. In the illustrated example line b-b is assumed to have a length of 3.5 inches and lines b-c are assumed to have a length of 1.375 inches. Angle θ is the angle between the arm 42 and horizontal where angle θ changes as the arm 42 is rotated by the user. Angle ϕ is the angle of the path of travel of the followers 26 and 30 relative to horizontal. In the illustrated example ϕ is 10°. Angle μ is the angle between the handle and the lever arm b-b. In the illustrated example angle μ is 47.96°.

Figure 9:
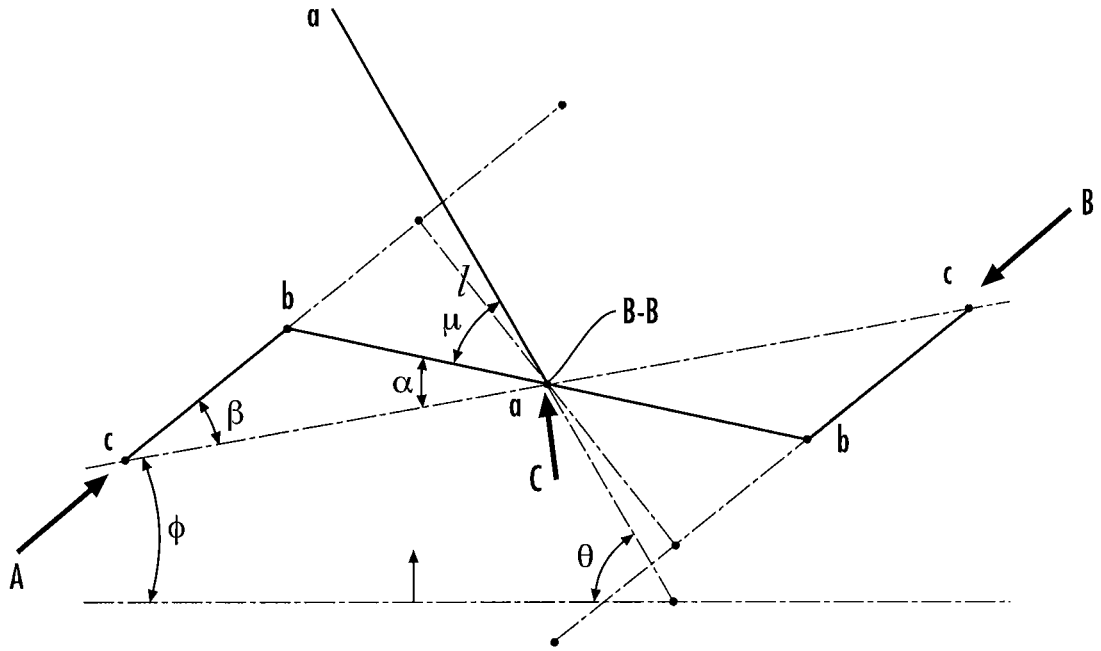
FIG. 9 is a static model of the linkage of FIG. 8 for calculation purposes.

FIG. 9 shows a simplified model for calculation purposes. Force Vector A is the normal force on the front follower 26, Force Vector B is the normal force on the rear follower 34 and Force Vector C is the force exerted by the housing 2 on the bearing 49 of the drive assembly 50. From the above information the following relationships are obtained:

$$\alpha=10°+\theta-47.96°$$

$$\beta=\arcsin(1.75\sin\alpha/1.375)$$

$I=1.75\sin(\alpha+\beta)$, where I is a line normal to and between the lines of Force Vectors A and B through axis of rotation B-B.

Three equilibrium equations are:

$$11.5\,F=Al+Bl$$

$$A\sin(\beta+10°)+C\cos 10°=F\cos\theta+B\sin(\beta+10°)$$

$$A\cos(\beta+10°)=C\sin 10°+F\sin\theta+B\cos(\beta+10°)$$

From the three equilibrium equations, the relation of the reaction forces A, B and C maybe calculated with the applied force F at handle 40 for different angles of θ as follows:

$$B=\frac{\frac{11.5F}{l}(\sin(\beta+10°)\tan 10°+\cos(\beta+10°))-F(\cos\theta\tan 10°+\sin\theta)}{2(\sin(\beta+10°)\tan 10°+\cos(\beta+10°))}$$

$$A=\frac{11.5F}{l}-B$$

$$C=\frac{F(\cos\theta+B\sin(\beta+10°)-A\sin(\beta+10°)}{\cos 10°}$$

The results for these calculations for a range of angles θ are shown in Table 1.

| ANGLE | FORCE A | FORCE B | FORCE C |
|---|---|---|---|
| 73 | 242.704 | 155.468 | −56.4342 |
| 72 | 242.852 | 158.182 | −51.9717 |
| 71 | 243.495 | 161.193 | −47.7248 |
| 70 | 244.627 | 164.522 | −43.6676 |
| 69 | 246.252 | 168.194 | −39.7786 |
| 68 | 248.382 | 172.237 | −36.0396 |
| 67 | 251.033 | 176.684 | −32.4358 |
| 66 | 254.229 | 181.573 | −28.9544 |
| 65 | 258.003 | 186.945 | −25.5846 |
| 64 | 262.395 | 192.852 | −22.3172 |
| 63 | 267.455 | 199.351 | −19.1442 |
| 62 | 273.245 | 206.511 | −16.0588 |
| 61 | 279.838 | 214.413 | −13.0551 |
| 60 | 287.326 | 223.153 | −10.1278 |
| 59 | 295.818 | 232.844 | −7.27258 |
| 58 | 305.446 | 243.626 | −4.48552 |
| 57 | 316.375 | 255.664 | −1.76314 |
| 56 | 328.804 | 269.164 | 0.897496 |
| 55 | 342.984 | 284.377 | 3.49905 |
| 54 | 359.229 | 301.621 | 6.04379 |
| 53 | 377.935 | 321.297 | 8.53376 |
| 52 | 399.617 | 343.919 | 10.9707 |
| 51 | 424.946 | 370.162 | 13.3562 |
| 50 | 454.819 | 400.923 | 15.6916 |
| 49 | 490.457 | 437.428 | 17.9780 |
| 48 | 533.572 | 481.388 | 20.2166 |
| 47 | 586.633 | 535.275 | 22.4080 |
| 46 | 653.338 | 602.788 | 24.5533 |
| 45 | 739.490 | 689.732 | 26.6529 |
| 44 | 854.736 | 805.754 | 28.7074 |
| 43 | 1016.38 | 968.159 | 30.7173 |
| 42 | 1258.86 | 1211.39 | 32.6830 |
| 41 | 1661.94 | 1615.20 | 34.6047 |
| 40 | 2461.76 | 2415.75 | 36.4827 |
| 39 | 4802.75 | 4757.46 | 38.3172 |

As is shown, for a given input force F (60 lbs in the example) the contact forces A, B and C change with the load angle. The calculation assumes all components to be rigid bodies. For angles smaller than 43 degrees, this assumption may not hold and the calculation closes to a singularity point (θ=38.7°) such that the calculation for angles smaller than 43 degrees may be less accurate.

Figure 10:
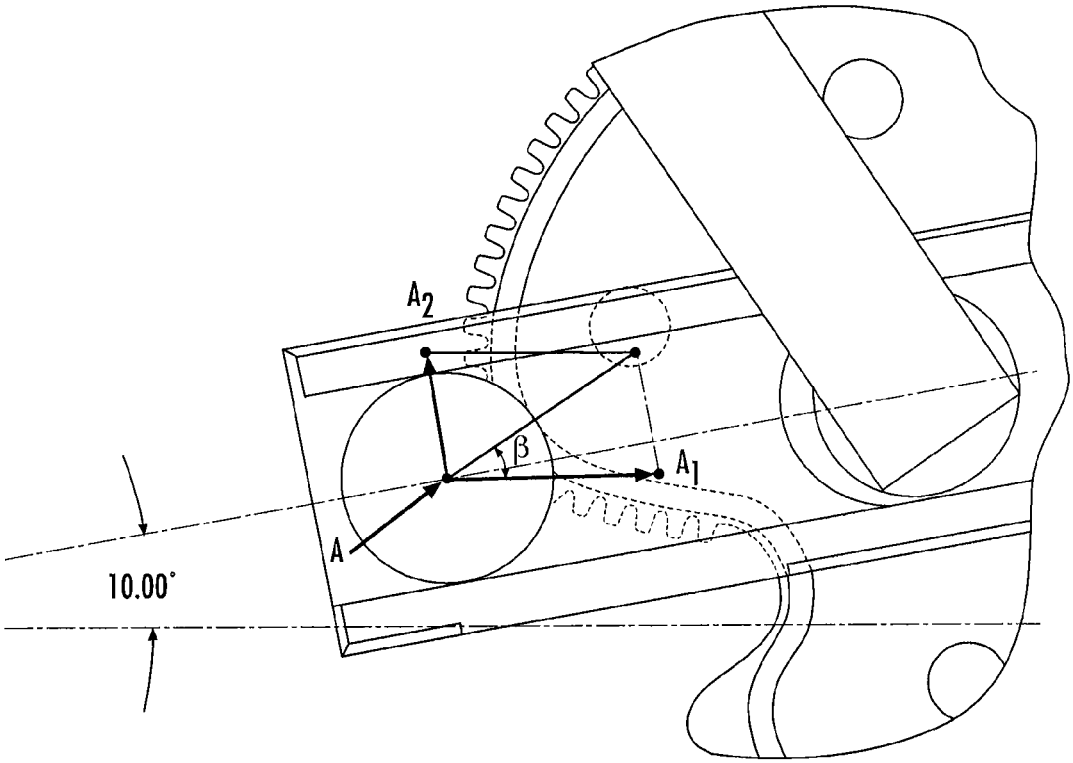
FIG. 10 is a diagram showing the force vectors on the front follower.

Referring to FIG. 10 the component forces on the front follower 26 are calculated as follows:

$$A_1=A(\cos\beta/\cos 10°)$$

$$A_2=A(\sin\beta+\cos\beta\tan 10°)$$

The results of this calculation is shown in Table 2:

| ANGLE | FORCE A | FORCE B | FORCE C | FORCE A1 | FORCE A2 |
|---|---|---|---|---|---|
| 73 | 242.704 | 155.468 | −45.4342 | 168.241 | 206.567 |
| 72 | 242.852 | 158.182 | −51.9717 | 173.047 | 203.066 |
| 71 | 243.495 | 161.193 | −47.7248 | 178.033 | 199.881 |
| 70 | 244.627 | 164.522 | −43.6676 | 183.230 | 196.988 |
| 69 | 246.252 | 168.194 | −39.7786 | 188.671 | 194.369 |
| 68 | 248.382 | 172.237 | −36.0396 | 194.395 | 192.009 |
| 67 | 251.033 | 176.684 | −32.4358 | 200.440 | 189.896 |
| 66 | 254.229 | 181.573 | −28.9544 | 206.850 | 188.023 |
| 65 | 258.003 | 186.945 | −25.5846 | 213.677 | 186.384 |
| 64 | 262.395 | 192.852 | −22.3172 | 220.975 | 184.979 |
| 63 | 267.455 | 199.351 | −19.1442 | 228.809 | 183.806 |
| 62 | 273.245 | 206.511 | −16.0588 | 237.254 | 182.870 |
| 61 | 279.838 | 214.413 | −13.0551 | 246.395 | 182.177 |
| 60 | 287.326 | 223.153 | −10.1278 | 256.333 | 181.737 |
| 59 | 295.818 | 232.844 | −7.27258 | 267.189 | 181.566 |
| 58 | 305.446 | 243.626 | −4.48552 | 279.106 | 181.681 |
| 57 | 316.375 | 255.664 | −1.76314 | 292.256 | 182.108 |
| 56 | 328.804 | 269.164 | 0.897496 | 306.849 | 182.879 |
| 55 | 342.984 | 284.377 | 3.49905 | 323.147 | 184.033 |
| 54 | 359.229 | 301.621 | 6.04379 | 341.471 | 185.624 |
| 53 | 377.935 | 321.297 | 8.53376 | 362.232 | 187.719 |
| 52 | 399.617 | 343.919 | 10.9707 | 385.955 | 190.407 |
| 51 | 424.946 | 370.162 | 13.3562 | 413.327 | 193.804 |
| 50 | 454.819 | 400.923 | 15.6916 | 445.262 | 198.066 |
| 49 | 490.457 | 437.428 | 17.9780 | 483.005 | 203.407 |
| 48 | 533.572 | 481.388 | 20.2166 | 528.298 | 210.128 |
| 47 | 586.633 | 535.275 | 22.4080 | 583.650 | 218.662 |
| 46 | 653.338 | 602.788 | 24.5533 | 652.821 | 229.661 |
| 45 | 739.490 | 689.732 | 26.6529 | 741.706 | 244.148 |
| 44 | 854.736 | 805.754 | 28.7074 | 860.104 | 263.822 |
| 43 | 1016.38 | 968.159 | 30.7173 | 1025.59 | 291.734 |
| 42 | 1258.86 | 1211.39 | 32.6830 | 1273.13 | 333.956 |
| 41 | 1661.94 | 1615.20 | 34.6047 | 1683.73 | 404.552 |
| 40 | 2461.76 | 2415.75 | 36.4827 | 2497.17 | 545.160 |
| 39 | 4802.75 | 4757.46 | 38.3172 | 4875.54 | 957.575 |

The force exerted by the drive roller 22 on the mop corresponds to force $A_1$ neglecting losses due to elasticity in the system. For example for a 60 lb input force at an angle of 60° a force of approximately 256 lb is generated at the drive roller. For a 60 lb input force at an angle of 45° a force of approximately 741 lb is generated at the drive roller.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A wringer for a mop comprising:

a drive roller mounted for rotational movement and linear movement in a track;

a first gear operatively connected to the drive roller for rotating the drive roller;

a drive assembly comprising a first cam surface, a second cam surface and a second gear, the first cam surface engaging a first follower where the first follower is operatively connected to the drive roller such that linear movement of the first cam follower results in linear movement of the drive roller, the second cam surface engaging a second follower, the second follower being stationary, and the second gear engaging the first gear; the drive assembly being mounted for rotational movement over a range of motion such that the first cam surface, the second cam surface and the second gear rotate about a common axis where rotation of the drive assembly for a first portion of the range of motion causes the rotational movement and the linear movement of the drive roller and rotation of the drive assembly for a second portion of the range of motion causes only the rotational movement of the drive roller.

2. The wringer of claim 1 wherein the drive roller and drive assembly are mounted in a housing, the housing being supported on a bucket.

3. The wringer of claim 2 wherein the track comprises spaced guide rails formed as protrusions on the housing.

4. The wringer of claim 1 further comprising a driven roller where the linear movement of the drive roller is toward the driven roller.

5. The wringer of claim 4 wherein the position of the driven roller relative to the drive roller is adjustable to vary a space between the drive roller and the driven roller.

6. The wringer of claim 5 wherein the driven roller is mounted on an eccentric cam wheel where rotation of the cam wheel adjusts a distance between the drive roller and the driven roller.

7. The wringer of claim 1 wherein the drive roller rotates on an axle about a first axis of rotation and the first gear is fixed to the drive roller concentric with the first axis.

8. The wringer of claim 7 wherein the first follower is mounted concentric with the first axis and the first gear such that the first follower rotates relative to the first gear.

9. The wringer of claim 1 wherein the first follower is constrained to move linearly along the track.

10. The wringer of claim 1 further comprising a handle operatively connected to the drive assembly such that rotation of the handle results in rotation of the drive assembly about a second axis of rotation.

11. The wringer of claim 1 wherein the drive assembly rotates about a second axis of rotation and comprises a bearing that is centered on the second axis of rotation and is located in the track.

12. The wringer of claim 11 wherein the first cam surface has a shape comprising a first portion that extends away from the second axis of rotation and a second portion that is on an arc of a circle centered on the second axis of rotation.

13. The wringer of claim 12 wherein the second gear has a shape that is the same as the shape of the first cam surface.

14. The wringer of claim 12 wherein the shape of the first cam surface controls a rate and a distance of linear movement of the drive roller.

15. The wringer of claim 11 wherein the second cam surface comprises a third portion that extends away from the second axis of rotation and a fourth portion that is on an arc of a circle centered on the second axis of rotation.

16. The wringer of claim 1 wherein the drive assembly rotates about a second axis of rotation such that the drive assembly may rotate relative to the track and translate along the track.

17. The wringer of claim 1 wherein the second gear has the same shape as the first cam surface.

18. The wringer of claim 1 wherein the first gear engages the second gear over the entire range of motion.

19. A method of operating a wringer having a driven roller and a drive roller, comprising:

rotating a drive assembly comprising a first cam surface, a second cam surface and a gear over a range of motion;

moving a first cam follower toward the driven roller using the first cam surface and moving the drive assembly toward the driven roller by engaging a second cam follower with the second cam surface such that movement of the first cam follower and the drive assembly results in linear movement of the drive roller toward the driven roller for a first portion of the range of motion;

rotating the drive roller using the gear over the entire range of motion.

20. A wringer for a mop comprising:

a drive roller mounted for rotational movement and linear movement in a track;

a first gear operatively connected to the drive roller for rotating the drive roller;

a drive assembly comprising a first cam surface and a second gear where the second gear has a non-round shape for at least a portion of the second gear, the first cam surface engaging a follower, and the second gear engaging the first gear; the drive assembly being mounted for rotational movement over a range of motion such that rotation of the drive assembly for a first portion of the range of motion causes the rotational movement and the linear movement of the drive roller and rotation of the drive assembly for a second portion of the range of motion causes only the rotational movement of the drive roller; the follower being stationary during the entire range of motion.

21. A wringer for a mop comprising:

a drive roller mounted for rotational movement and linear movement in a track;

a first gear operatively connected to the drive roller for rotating the drive roller;

a drive assembly comprising a first cam surface, a second cam surface and a second gear, the first cam surface engaging a first follower where the first follower is operatively connected to the drive roller such that linear movement of the first cam follower results in linear movement of the drive roller, the second cam surface engaging a second follower, the second follower being stationary, and the second gear engaging the first gear; the drive assembly being mounted for rotational movement over a range of motion such that rotation of the drive assembly for a first portion of the range of motion causes the rotational movement and the linear movement of the drive roller and rotation of the drive assembly for a second portion of the range of motion causes only the rotational movement of the drive roller;

a driven roller disposed such that the linear movement of the drive roller is toward the driven roller, the driven roller being mounted on an eccentric cam wheel where rotation of the cam wheel adjusts the position of the driven roller relative to the drive roller to adjust a distance between the drive roller and the driven roller.

22. A wringer for a mop comprising:

a drive roller mounted for rotational movement and linear movement in a track where the drive roller rotates on an axle about a first axis of rotation and a first gear is fixed to the drive roller concentric with the first axis for rotating the drive roller;

a drive assembly comprising a first cam surface, a second cam surface and a second gear, the first cam surface engaging a first follower where the first follower is mounted concentric with the first axis and the first gear such that the first follower rotates relative to the first gear such that linear movement of the first cam follower results in linear movement of the drive roller, the second cam surface engaging a second follower, the second follower being stationary, and the second gear engaging the first gear; the drive assembly being mounted for rotational movement over a range of motion such that rotation of the drive assembly for a first portion of the range of motion causes the rotational movement and the linear movement of the drive roller and rotation of the drive assembly for a second portion of the range of motion causes only the rotational movement of the drive roller.

23. A wringer for a mop comprising:

a drive roller mounted for rotational movement and linear movement in a track;

a first gear operatively connected to the drive roller for rotating the drive roller;

a drive assembly comprising a first cam surface, a second cam surface and a second gear, the first cam surface engaging a first follower where the first follower is operatively connected to the drive roller such that linear movement of the first cam follower results in linear movement of the drive roller, the second cam surface engaging a second follower, the second follower being stationary, and the second gear engaging the first gear; the drive assembly rotatable about a second axis of rotation and comprising a bearing that is centered on the second axis of rotation and is located in the track;

the drive assembly being mounted for rotational movement over a range of motion such that rotation of the drive assembly for a first portion of the range of motion causes the rotational movement and the linear movement of the drive roller and rotation of the drive assembly for a second portion of the range of motion causes only the rotational movement of the drive roller.

* * * * *